US005181724A

United States Patent [19]

Spadoni

[11] Patent Number: 5,181,724

[45] Date of Patent: Jan. 26, 1993

[54] WING SHOOTING TARGET

[76] Inventor: Vittorio Spadoni, No. 11, Via Aristofane, App. 25, 00125 Roma, Italy

[21] Appl. No.: 781,801

[22] Filed: Oct. 28, 1991

[30] Foreign Application Priority Data

Oct. 30, 1990 [IT] Italy ..... 48422 A/90

[51] Int. Cl.[5] ..... F41J 9/16

[52] U.S. Cl. ..... 273/363; 273/58 K; 273/380; 273/127 A

[58] Field of Search ..... 272/363, 363, 380, 61 A, 272/127 A, 424, 425, 344, 58 R, 58 B, 58 F, 58 K

[56] References Cited

U.S. PATENT DOCUMENTS

| | | | |
|---|---|---|---|
| 299,835 | 6/1884 | Moyer | 273/362 |
| 2,835,073 | 5/1958 | Dame | 273/424 X |
| 2,930,161 | 3/1960 | Hellman | 273/344 X |
| 3,617,589 | 11/1971 | Hinton et al. | 273/61 A X |
| 4,212,460 | 7/1980 | Kraft | 273/58 B |
| 4,352,496 | 10/1982 | Lante-Montefeltro della Rovere | 273/363 |
| 4,433,843 | 2/1984 | Bertini | 273/363 |

*Primary Examiner*—William H. Grieb

*Attorney, Agent, or Firm*—Jacobson, Price, Holman & Stern

[57] ABSTRACT

The invention relates to a wing shooting target made up of an internally empty body, subdivided into two half-portions (1, 2) integrally coupled to each other at the time of shooting, endowed with at least two radial vanes (3) and realized in a light material.

8 Claims, 2 Drawing Sheets

WING SHOOTING TARGET

DISCLOSURE OF THE INVENTION

The present invention relates to a wing shooting target.

More particulaly, the invention relates to a target so structurally studied as to imitate, as exactly as possible, the flight of a pigeon, so allowing the practice of this particular kind of sporting activity.

As is known, two well defined kinds of sporting shooting exist, referred to as clay-pigeon shooting and pigeon shooting.

The latter kind of sport has been abolished mainly for ethical and moral reasons.

However, its practice was able to give rise to a particular interest in the fans chiefly by virtue of the indeterminateness of the trajectory of the flight of the pigeon, and, teherefore, of the greater shooting difficulty.

In more recent times several solutions have been suggested for a target that, once shot, can imitate the flight of a pigeon.

The suggested solutions mainly provide the utilization of a clay-pigeon which propellers are applied to.

The employment of these targets has soon fallen into disuse because such targets were characterized by several shortcomings that didn't allow a correct activity.

In particular, the clay-pigeon in most cases didn't separate from the propeller, though regularly hit, whereby it ended, apparently integral, beyond the limits of the shooting ground, thus not making a valid point for the shooter.

This obviously gave rise to several controversies, rendering the competition impracticable.

The main cause of this shortcoming was the one associated with the difficulty in maintaining the propeller and the clay-pigeon joined together during the shooting stage, that is to say when these are subjected to a high speed, and, at the same time, in allowing their separation as a consequence even of an only shot fired by the shooter.

Another shortcoming of the targets suggested in the past is the one associated with the of the propeller, which has a considerable weight and encumbrance.

The Applicant, having considered the problems mentioned above and having taken into account the specific exigencies of a shooter and, in a broader sense, the whole background organization (Clubs, public, sporting federations) has realized a target able to obviate all the aforementioned shortcomings, being able to replicate, in a satisfactorily exact way, the flight of a pigeon and ensuring the regularity of a competition.

Another object of the present invention is to realize an extremely light, not very cumbersome and not dangerous target of the type mentioned above.

It is therefore a specific object of the present invention a wing shooting target made up of an internally empty body subdivided into two half-portions integrally coupled to each other at the time of shooting, endowed with at least two radial vanes and realized in a light material.

Preferably, according to the invention, said two half-portions are made up of two hemispheres, though it is apparent that they can be also of a different form.

The coupling between the two half-portions preferably will be realized under a vacuum, so that one has a very good holding at the shooting stage, but, at the same time, the two half-portions separate, at least one falling correspondingly to the impact point.

Further, according to the invention, said two half-portions may be glue or pressure coupled.

Said vanes will be provided, in a particularly preferred embodiment of the invention, in the number of three, arranged at 120° to each other.

The vanes of the target according to the invention will be, preferably, inclined of an angle variable between 8° and 18° to the horizontal direction.

In a particularly preferred embodiment of the target according to the present invenytion, said vanes are all arranged by the same half-portion of the body.

Moreover, in order to achieve a better strenght at the shooting stage, the portion of the vanes coupled to the body of the target will be endowed with a reinforcement web.

The free end of the vanes of the target according to the invention will be truncated and their thickness will increase from the portion adhering to the body towards the outside.

Again according to the present invention, a light material can be provided inside the body of the target, which material spreads into the air following the opening of the body itself, as for instance natural or man made feathers, confetti, colored powder, etc.

The two half-portions of the body can be realized in plastics, glass plastics or other light material and may be both realized from the same material or from different materials.

For instance, in the case in which the vanes are all by a same half-portion, the latter can be realized in plastics material and the other, which will be the one that falls more rapidly to the ground, can be realized in a glass-like plastics material.

BRIEF DESCRIPTION OF DRAWINGS

The present invention will be now described according to preferred embodiments thereof with particular reference to the figures of the annexed drawings, in which.

DESCRIPTION OF PREFERRED EMBODIMENT

Figure 1:
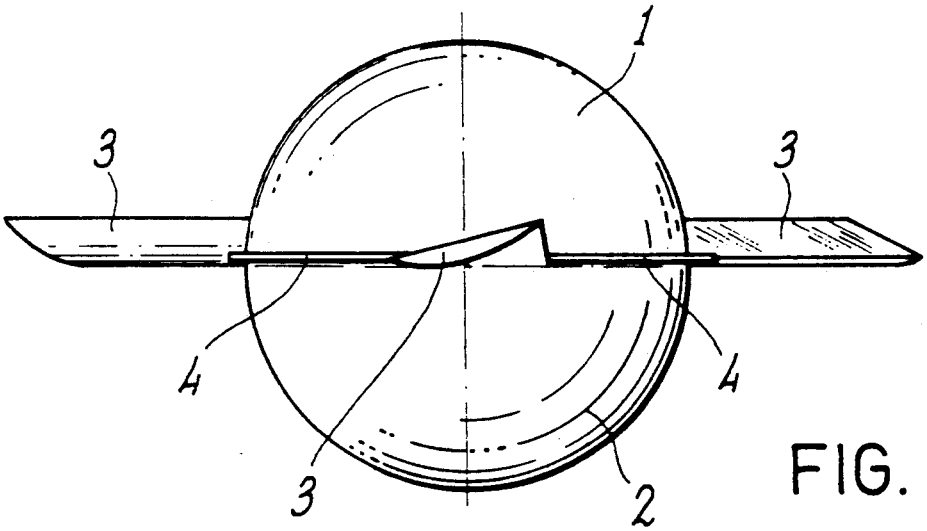
FIG. 1 is a front view of an embodiment of the target according to the invention.
Figure 2:
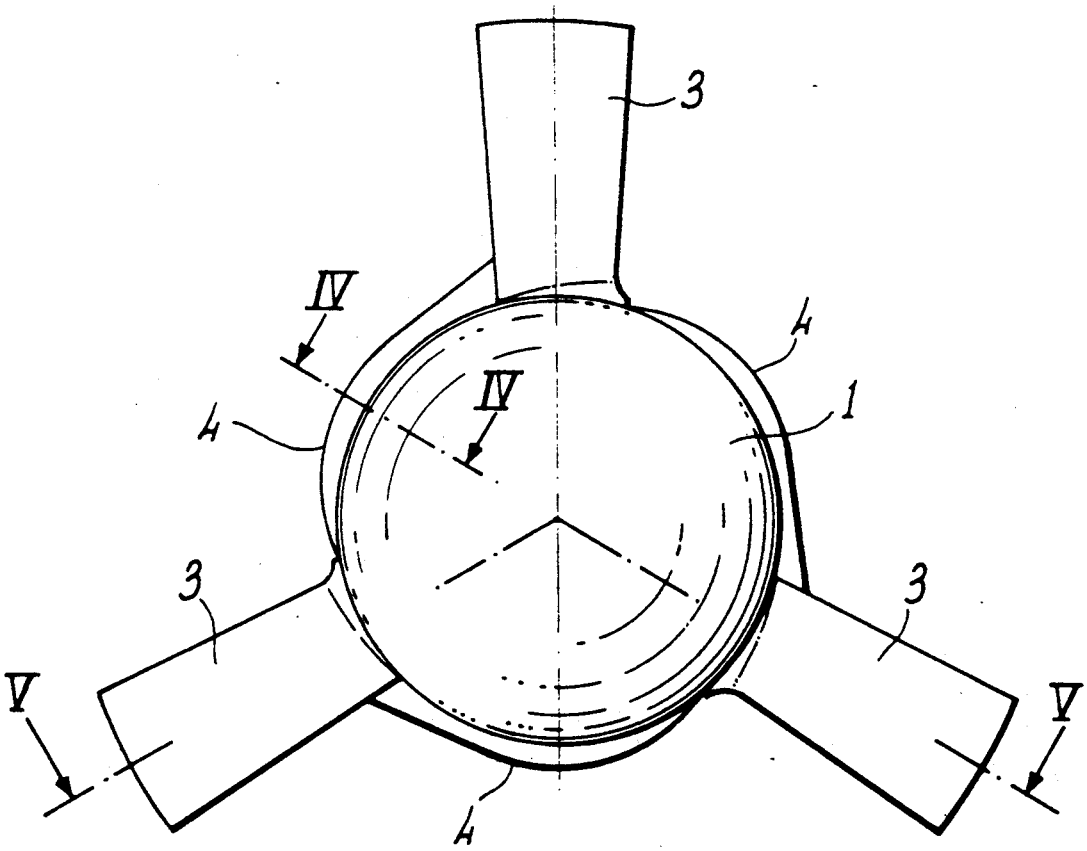
FIG. 2 is a top view of the target of FIG. 1.
Figure 3:
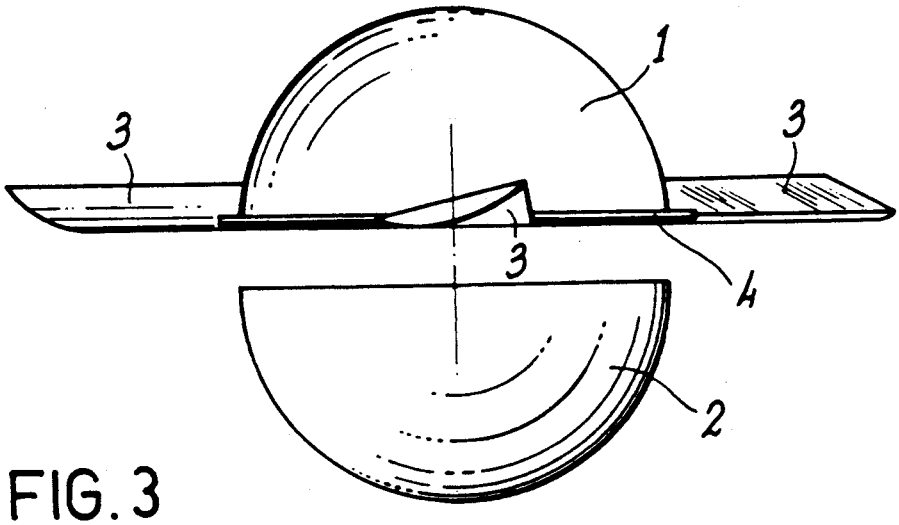
FIG. 3 is a side view of the target of FIG. 1 open.
Figure 4:
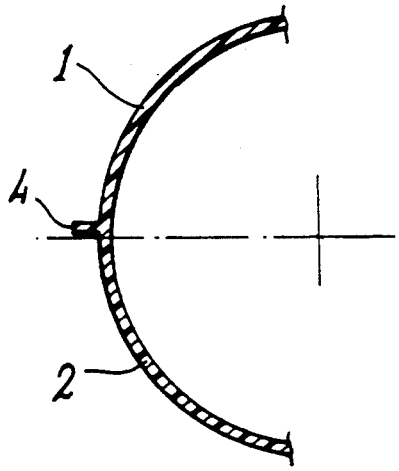
FIG. 4 is a section view of the target of FIG. 1, along the line IV—IV in FIG. 2.
Figure 5:
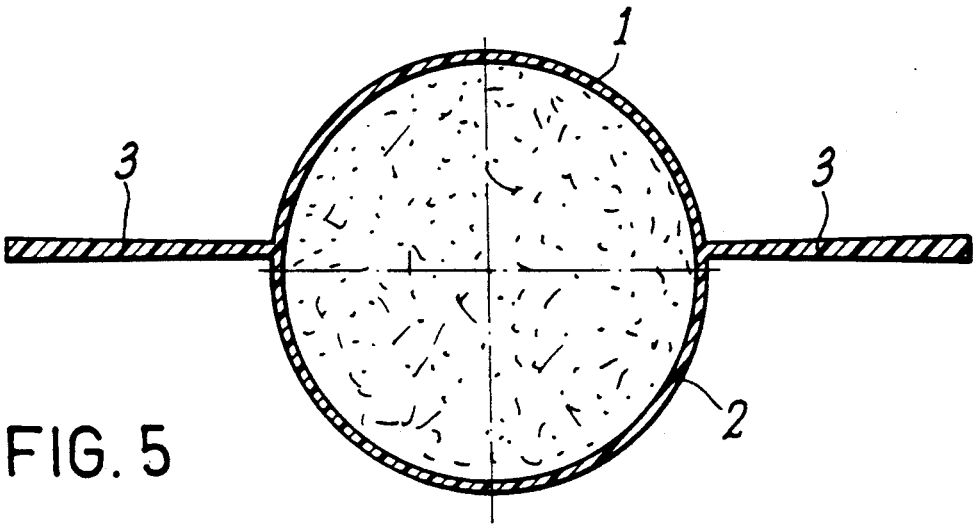
FIG. 5 is a section view of the target of FIG. 1 along the line V—V in FIG. 3.

In the embodiment represented in FIGS. 1 to 5, the target according to the invention is made up of two half-spheres 1, 2 airtight and circumferentially joined to each other.

The coupling between the two half-spheres 1, 2, as already mentioned, is realized under a vacuum so as to keep them coupled during the shooting, until a pressure difference persists with respect to the outside, and so that, once pierced, even by an only shot, they separate owing to the depression that arises.

In this way, the two half-spheres 1 and 2 certainly separate ensuring the fall of one or both correspondingly to the point of impact with the shot.

On the half-sphere 1 three vanes 3 are provided arranged at 120° an having a wing contour slightly enlarged towards the outside.

Said vanes 3 are angled with respect to the diametrical plane of the two half-spheres 1, 2 and outerly have a thickening.

The extremity of the vanes 3 opposite the one for the coupling with the half-sphere 1 is truncated.

They have on the contrary, correspondingly to their extremity adhering to the half-sphere 1, an appendix of reinforcing web 4 that reinforces their coupling with the half-sphere 1, allowing it to bear the high accelerations at the shooting stage.

At the interior of the two half-spheres 1 and 2 natural or man made feathers 5, or other similar dispersible material, such as confetti, colored powder, etc., are provided, whereby the fact is put into evidence that the target has been hit and a spectacular effect is obtained, such as the "plucking" of the hit pigeon, that causes an emotional reaction in the shooter that has hit the center.

When the target according to the present invention is thrown by the mechanical device, it receives a high speed rotating motion, with a consequent kinetic energy sufficient to bring it off shoot if not hit in the first stage of its trajectory.

The mechanical device determines in a casual way the shooting trajectory that undergoes, moreover, sudden variations as a consequence of wind gusts, that act upon the target in that this is very light, owing to the high rotation speed that generates a strong "magnus" effect upon it.

Moreover, as the target is thrown with the vanes 3 arranged on a plane between 20° and 45° with respect to the vertical, and as the stable equilibrium of the target detectable when the vanes rotate on the horizontal plane, one has another variation of the trajectory at about ⅓ of the time of flight of the target. In fact, as the rotation speed and the gyroscopic effect decrease, the center of gravity makes the target to rotate putting the vanes 3 in horizontal rotation, whereby the target itself rises with a translating flight until it reaches the hydrostatic equilibrium and thus falls back gliding.

The present invention has been disclosed with specific reference to preferred embodiments thereof, but it is to be understood that variations and/or modifications can be made by those skilled in the art, without so departing from the scope of the attached claims.

I claim:

1. A wing shooting target comprising a substantially spherical body with a hollow interior and a plurality of external radially extending vanes wherein the body comprises two substantially hemispherical hollow parts connected together and wherein the interior of the body is under vacuum.

2. A target as claimed in claim 1 wherein the vanes are three in number.

3. A target as claimed in claim 2 wherein the vanes are circumferentially spaced around the body substantially at 120° intervals.

4. A target as claimed in claim 1 wherein the vanes are each inclined at an angle of between 8° and 18° with respect to a plane extending equatorially through said body.

5. A target as claimed in claim 1 wherein the vanes all extend from one of said parts.

6. A target as claimed in claim 1 including reinforcing webs extending around the body from the base of each vane.

7. A target as claimed in claim 1 wherein the thickness of each vane increases outwardly from said body.

8. A target as claimed in claim 1 including a dispersable material contained within the interior of said body.

* * * * *